United States Patent [19]

Tzung-I

[11] Patent Number: 4,938,039

[45] Date of Patent: Jul. 3, 1990

[54] ACTUATING MECHANISM FOR PADLOCK

[76] Inventor: Lo Tzung-I, P.O. Box 96-405, Taipei, Taiwan, 10098

[21] Appl. No.: 349,038

[22] Filed: May 9, 1989

[51] Int. Cl.[5] ..... E05B 67/22

[52] U.S. Cl. ..... 70/38 A; 70/38 C

[58] Field of Search ..... 70/38 A, 38 R, 38 B, 70/38 C, 39, 24, 25, 26, 386

[56] References Cited

U.S. PATENT DOCUMENTS

| | | | |
|---|---|---|---|
| 2,141,748 | 12/1938 | Hansen | 70/38 A |
| 3,035,675 | 9/1974 | Lippisch | 70/38 A |
| 4,138,868 | 2/1979 | Richards | 70/38 A |

FOREIGN PATENT DOCUMENTS

| | | | |
|---|---|---|---|
| 455584 | 6/1945 | Canada | 70/38 A |
| 970987 | 7/1975 | Canada | 70/38 A |
| 118677 | 2/1965 | Fed. Rep. of Germany | 70/38 A |

*Primary Examiner*—Robert L. Wolfe

[57] ABSTRACT

It is an improved padlock structure, in which the actuating mechanism is particularly designed to include a lock cylinder and, an actuating assembly; the actuating assembly further includes a T-shaped bolt, a front guide plate, a rear guide plate, a return spring, and a cam member with two steel balls. The major features of this lock are its single structure and having little or no trouble in use.

3 Claims, 2 Drawing Sheets

ACTUATING MECHANISM FOR PADLOCK

BACKGROUND OF THE INVENTION

1. Field of the invention

This invention provides a padlock; particularly, this invention provides an improved actuating mechanism, which can easily be fixed in place and easily be assembled.

2. Description of the Prior Art

In the conventional padlocks, the coupling part of the cylinder has two actuating blocks, which are movably connected with the cam member. Between the cam member and the cylinder coupling part, there is a spring to enable the cam member to return its original position after the padlock being in locked position.

One end of the aforesaid spring is attached to one of the actuating blocks of the cam member, while the other end thereof is inserted in a small round hole on the wall of the lock body. As a result of the spring force and the space limit outside the cam member, installation of the spring is rather difficult. Since one end of the spring is simply hooked in place, it is susceptible to becoming disengaged from the actuating block; in that case, the lock will be out of order. It is particularly true to happen, when such a padlock is used on a container truck; the reason is that the spring can not be fixed in place securely.

Another prior art is that a spring is mounted between the cylinder coupling part and the cam member of the padlock; the spring is wound around a shaft with a salient block. After the shaft and spring being put in a positioning hole, the spring is movably fixed to the wall of the lock body portion. There is an inner shaft being mounted between the cylinder coupling part and the cam member; the other end of the spring is attached to one end of the inner shaft so as to provide a return force during the lock being unlocked and locked.

According to the aforesaid padlock, a spiral spring is installed between the cylinder coupling part and the cam member, and that padlock also has an inner shaft and outer shaft, whereby there are no drawbacks in assembling operation and to cause the spring to separate from the fixed part thereof in case of being shaken; however, that padlock needs a longer body portion so as to have sufficient space to accommodate the spiral spring, the inner and outer shafts.

SUMMARY OF THE INVENTION

In view of the drawbacks of the conventional padlocks, the inventor has developed a new actuating mechanism, which is substantially an actuating assembly being installed in front of the lock cylinder. The actuating assembly can control the lock shackle during locking or unlocking operation. The actuating assembly mainly comprises a cam member, a front guide plate, a rear guide plate, a T-shaped bolt and a return spring. The cam member has two opposite curved recesses to mount two steel balls respectively, and also has a round hole in the center thereof. The front end of the cam member has two opposite lugs. After mounting the front guide plate, the return spring and the rear guide plate on the T-shaped bolt, the bolt is installed into the center hole of the cam member, and is to be fixed in place with a pin to penetrate into a pin hole on the cam member, and then the actuating assembly is completely assembled. The inner end of the return spring is fixed in a square groove of the T-shaped bolt, while the outer end thereof is movably attached to a cylindrical fixed block, which is movably mounted in a block hole inside the lock body portion. Then, the actuating assembly is installed in place to control the lock shackle to move. The outer end of the T-shaped bolt is coupled with the driving member of the lock cylinder to receive the unlocking and locking force. Since the actuating assembly is a complete unit, which can facilitate the assembling operation of the whole padlock; further, the return spring of the actuating assembly would not be out of order upon being shaken.

The prime object of the present invention is to provide a padlock, in which the actuating assembly is a complete unit comprising a cam member, a front guide plate, a rear guide plate, a T-shaped bolt, and a return spring; the inner end of the return spring is movably attached to a square groove of the T-shaped bolt, while the outer end thereof is inserted in a cylindrical fixed block to prevent the return spring from being disengaged. The actuating assembly can easily be installed inside the body portion during assembling of the lock.

Another object of the present invention is to provide a new padlock, in which the T-shaped bolt of the actuating assembly may have a round or square bolt stem to penetrate the front guide plate, the return spring, the rear guide plate and finally to connect with the cam member. The other end of the T-shaped bolt is formed into a rectangular plate to be engaged with a cylinder coupling part so as to control the actuating assembly.

Still another object of the present invention is to provide a new padlock, in which the return spring is a coiled leaf spring; the inner end of the spring has a bent part to be engaged with the T-shaped bolt, while the outer end thereof has a straight portion to be connected with a cylindrical fixed block which is to be inserted in a block hole inside the body portion of the lock so as to fix the spring in place without becoming disengaged or loose. A further object of the present invention is to provide a new padlock, in which the center of the cam member of the actuating assembly has a round or a square hole for fitting the T-shaped bolt; the cam member has two opposite curved recesses for mounting two steel balls respectively. The inner end of the cam member has two opposite lugs for fitting the rear guide plate and the return spring therebetween. By means of the rear guide plate, the steel balls are separated from the return spring. The rear guide plate is mounted against the outer ends of the two lugs to prevent the T-shaped bolt from affecting the movement of the return spring.

DESCRIPTION OF THE PREFERRED EMBODIMENTS

Figure 1:
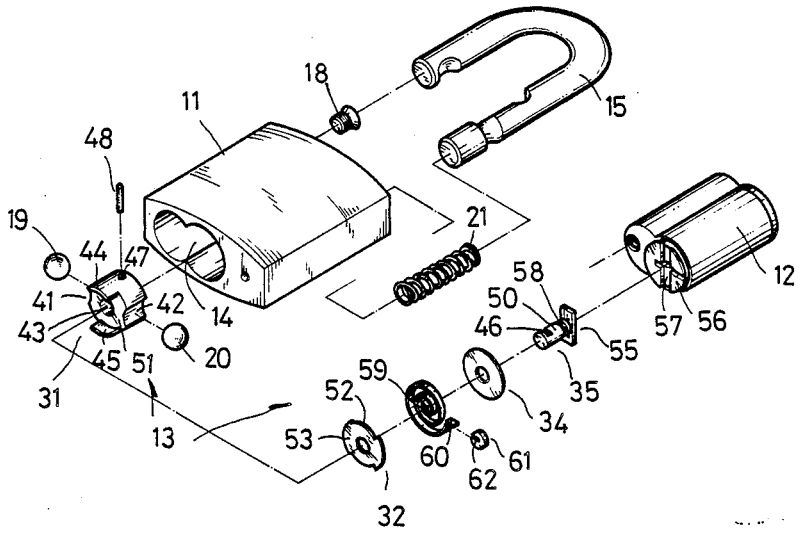
FIG. 1 is a disassembled view of an embodiment of the present invention.
Figure 2:
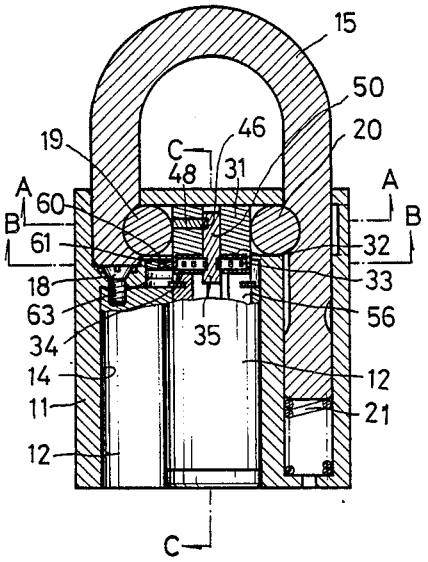
FIG. 2 is a sectional view of the present invention, showing the lock being in locked up state.
Figure 3:
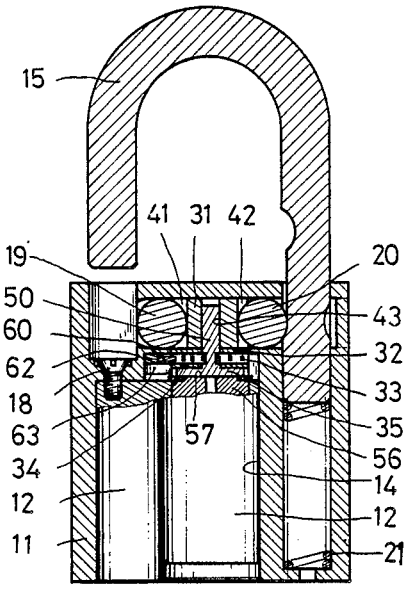
FIG. 3 is another sectional view of the present invention, showing the lock being in unlocked state.
Figure 4:
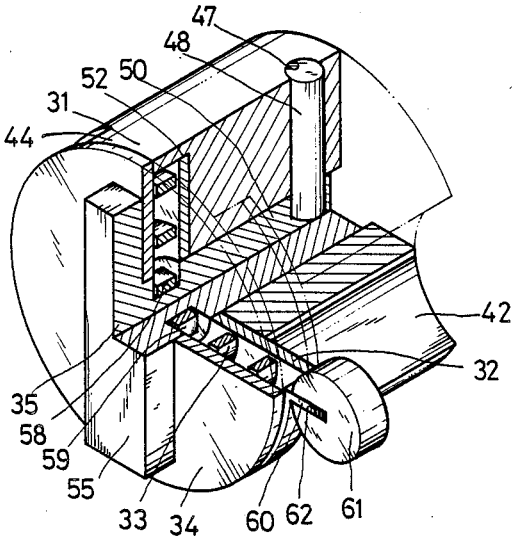
FIG. 4 is a fragmentary sectional view of the actuating assembly of the present invention.
Figure 5:
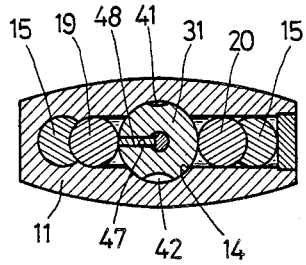
FIG. 5 is a sectional view taken along line A—A of FIG. 2.
Figure 6:
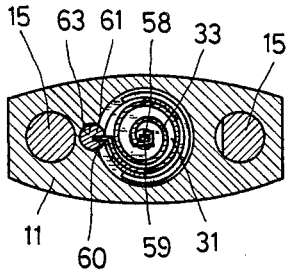
FIG. 6 is a sectional view taken along line B—B of FIG. 2.
Figure 7:
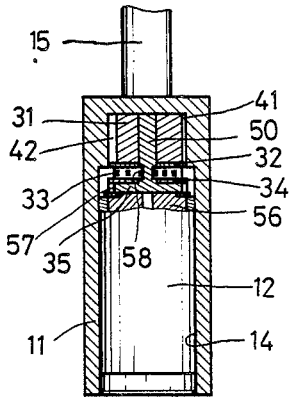
FIG. 7 is a sectional view taken along line C—C of FIG. 2.

Referring to FIGS. 2 and 3, there is shown a padlock according to the present invention, which mainly comprises a body portion 11, a lock cylinder 12, an actuating assembly 13, and a shackle 15. The actuating assembly 13 and the lock cylinder 12 are mounted in a cylinder hole 14 in the body portion 11. One end of the body portion 11 is furnished with two round holes for receiving the shackle 15. The actuating assembly 13 and the lock cylinder 12 are fixedly fitted in the body portion 11 by means of a screw 18. The shackle 15 is to be set at a locked or unlocked position by means of two steel balls 19 and 20 mounted on both sides of the actuating assembly 13. One of the balls is also used to prevent the shackle from being separated from the body portion 11. The rotation movement of the lock cylinder 12 can set the lock in locking up or unlocked state because of the actuating assembly 13 able to control the two steel balls 19 and 20 to move into the locking up or unlocked position. A spring 21 mounted in a round hole 17 is used to move the shackle in unlocked position upon the shackle being released by the balls.

The actuating assembly 13 as shown in FIGS. 1 to 7 mainly includes a cam member 31, a front guide plate 32, a return spring 33, a rear guide plate 34, and a T-shaped bolt 35; the actuating assembly 13 is fitted in the cylinder hole 14 of the body portion 11, and is to be operated together with the lock cylinder 12.

Figure 8:
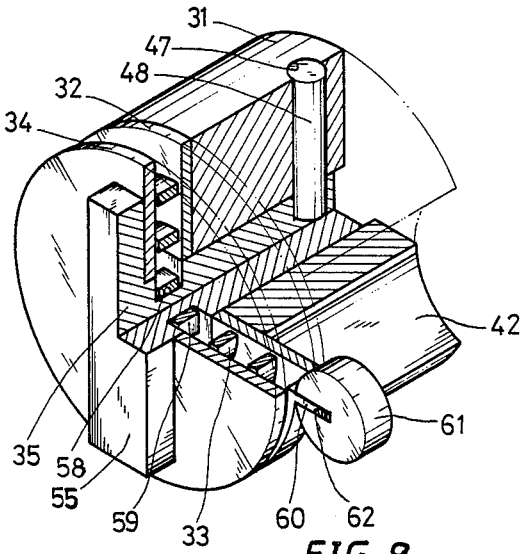
FIG. 8 is a fragmental sectional view of another embodiment of the actuating assembly according to the present invention.

In the actuating assembly 13, the cam member 31 is a cylindrical member, which includes two curved recesses 41 and 42 for receiving two steel balls 19 and 20 respectively. When the cam member 31 is rotated, the two steel balls 19 and 20 will also be moved to caused the shackle to be set at a locked up or unlocked position. The center of the cam member 31 has a round hole 43, and the edge of the inner surface 51 of the cam member 31 has two lugs 44 and 45. A T-shaped bolt 35 is fitted in the round hole 43 so as to hold the rear guide plate 34, the return spring 33 and the front guide plate 32 together; the bolt stem 50 of the T-shaped bolt 35 has a groove 46, which is exactly aligned with a pin hole 47 on the cam member 31 so as to facilitate a pin 48 to insert therein for assembling the T-shaped bolt 35 and the cam member 31 together. In that case, the rear guide plate 34 is exactly set against the outer ends of the two lugs 44 and 45. The bolt stem 50 of the T-shaped bolt 35 can also be made into a square shape as shown in FIG. 8.

After the actuating assembly 13 that includes the rear guide plate 34, the return spring 33, the front guide plate 32 and the T-shaped bolt 35 is assembled together with the cam member 31, the front guide plate 32 is to be mounted against the inner surface 51 between the two lugs of the cam member 31. The two indented edges 52 of the front guide plate 32 are set against the inner surface 51 of the cam member 31, while the two convex edges 53 are set against the ends of the curved recesses 41 and 42 of the cam member 31 respectively so as to maintain the steel balls in the recesses 41 and 42 respectively.

One end of the T-shaped bolt 35 has a rectangular plate 55 to be mated with a rectangular groove 57 on the driving member 56 of the lock cylinder so as to provide a mechanical coupling function after the lock cylinder 12 and the actuating assembly 13 are assembled together. The bolt stem 50 of the T-shaped bolt 35 has a square groove 58 to be used for retaining the inner end 59 of the return spring 33. When the T-shaped bolt 35 is driven by the driving member 56, the spring 33 will be wound to store a mechanical force, which will provide a return force upon being released.

In the actuating assembly 13, the T-shaped bolt 35 is used to assemble the other parts such as the rear guide plate 34, the return spring 33 and the front guide plate 32 together. The actuating assembly 13, can, upon the lock being unlocked, return to its original position by means of the return spring 33, of which the inner end 59 is fixed in the square groove 58, while the outer end of the spring has a straight portion 60 being embedded in the slot 62 of a cylindrical block 61.

The actuating assembly 13 is installed in the cylinder hole 14 of the body portion 11. Both sides of the cam member 31 are fitted with two steel balls 19 and 20 respectively. In the cylinder hole 14, there is also a block hole 63 for positioning the cylindrical block 61. After all the parts are fitted in the cylinder hole 14, the outer end of the return spring 33 is fixed in place by means of the cylindrical block 61 so as to provide the actuating assembly 13 with a force to return to its original position upon the lock being unlocked.

In the present invention, the return spring 33 is fitted in place, by means of the rear guide plate 34, near the end of the two lugs 45 and 46 of the cam member 31, i.e, the return spring 33 is mounted between the front and rear guide plates 32 and 34 to have sufficient winding or unwinding space.

Another embodiment of the actuating assembly is shown in FIG. 8, in which the cam member 31 is not provided with lugs; the front guide plate 32 and the inner surface 51 of the cam member 31 are in close contact with each other. The return spring 33 is fitted between the front and rear guide plates 32 and 34; after mounting the T-shaped bolt 35 in place, the actuating assembly 13 can also provide the same function in the lock.

Briefly, the actuating assembly of the present invention is coupled with the lock cylinder by means of the T-shaped bolt; then, the return spring is mounted in place by means of a cylindrical block and a block hole in the body portion so as to make the cam member rotating freely during locking and unlocking operation without causing the actuating assembly to become loose or malfunction. The structure of the present invention is deemed practical and novel.

I claim:

1. An improved actuating mechanism for a padlock comprising an actuating assembly mounted in said lock in front of a during member of a lock cylinder, and said actuating assembly including:

a cam member in cylindrical shape being mounted in front of a cylinder hole in said lock, and both sides of said cam member being furnished with two curved recesses for installing two steel balls respectively; and the center of said cam member having a hole for receiving a T-shaped bolt; and the front end of said cam member having two opposite lugs;

a front guide plate having two symmetrical indented edges, and having a hole in the center thereof, and said front guide plate being mounted against said two lugs of said cam member, and said two indented edges being mounted within and against said two lugs respectively;

a return spring being mounted on the outer side of said front guide, and the inner end of said return spring being pivotally connected with a T-shaped bolt, while the outer end of said return spring having a straight portion to be connected with a cylindrical block which is fitted in a block hole in the body portion of said padlock;

a rear guide plate having a hole in the center thereof, and being mounted on the outside of said two lugs;

a T-shaped bolt, of which the bolt stem penetrates said rear guide plate, said return spring, said front guide plate and said cam member, and then being fixed in place with a pin; and said bolt stem having a square groove for fixedly mounting the inner end of said return spring, while the other end of said bolt stem having a rectangular plate to be engaged with a rectangular groove on said driving member.

2. An improved actuating mechanism for a padlock as claimed in claim 1, wherein said cam member of said actuating assembly is furnished with two opposite lugs, and the space between said two lugs being installed with said front plate and said return spring, and said rear guide plate being mounted on the outer ends of said two lugs, and after T-shaped bolt is mounted in place, said rear guide plate being fixed in place; and said cam member may be without said lugs; and said front guide plate being just a round plate; and after said T-shaped bolt is assembled together with said other parts, said T-shaped bolt and said cam member being able to rotate by means of said return spring.

3. An improved actuating mechanism for a padlock as claimed in claim 1, wherein said T-shaped bolt of said actuating assembly has a bolt stem in a suitable shape, and the hole in said rear guide plate, said front guide plate and said cam member being the same as the shape of said T-shaped bolt.

* * * * *